United States Patent [19]

Lier

[11] Patent Number: 4,583,342

[45] Date of Patent: Apr. 22, 1986

[54] SECUREMENT OF GLASS IN FIRE DOORS AND THE LIKE

[76] Inventor: Clifford S. Lier, 923 Wentworth Avenue, North Vancouver, B.C., Canada

[21] Appl. No.: 581,613

[22] Filed: Feb. 21, 1984

Related U.S. Application Data

[62] Division of Ser. No. 448,621, Dec. 10, 1982, abandoned.

[30] Foreign Application Priority Data

Dec. 11, 1981 [CA] Canada ..... 392121

[51] Int. Cl.[4] ..... E06B 3/00

[52] U.S. Cl. ..... 52/714; 52/208; 52/455; 52/476; 52/785

[58] Field of Search ..... 52/714, 208, 288, 455–458, 52/476, 785, 716–718, 813, 1

[56] References Cited

U.S. PATENT DOCUMENTS

| | | | |
|---|---|---|---|
| 1,946,716 | 2/1934 | Smidt | 52/455 X |
| 2,505,789 | 5/1950 | Norquist . | |
| 2,654,920 | 10/1953 | Kessler | 52/455 X |
| 3,308,013 | 3/1967 | Bryant | 162/103 |
| 3,371,003 | 2/1968 | Goldman | 156/267 |
| 3,641,721 | 2/1972 | Martin | 52/456 X |
| 3,731,443 | 5/1973 | Zaroor | 52/309 |
| 4,073,108 | 2/1978 | Williams | 52/714 X |
| 4,104,828 | 8/1978 | Naslund et al. | 49/399 |
| 4,332,111 | 6/1982 | Terashima | 52/455 X |
| 4,343,127 | 8/1982 | Greve et al. | 52/785 |
| 4,364,209 | 12/1982 | Gebhard | 52/208 |

FOREIGN PATENT DOCUMENTS

| | | | |
|---|---|---|---|
| 524603 | 5/1956 | Canada . | |
| 767427 | 9/1967 | Canada | 108/32 |
| 861839 | 1/1971 | Canada | 108/48 |
| 1205110 | 9/1970 | United Kingdom | 52/455 |

*Primary Examiner*—J. Karl Bell

[57] ABSTRACT

Apparatus for securing glass panels in fire barriers comprises an elongated glazing strip made of layers of sheet material adhered together. The sheet material is formed from a slurry mixture of wood fibers and a fire retardant chemical by the use of heat and pressure. The panels are also preferably secured by metal clips having a flat base of thin sheet material and upstanding, elongated projections from the base that are parallel to each other and spaced apart by a distance corresponding to the width of the glass panel to be secured. This arrangement makes it possible to locate glass panels in fire barriers without substantial reduction in the ability of the barrier to contain a fire.

13 Claims, 12 Drawing Figures

SECUREMENT OF GLASS IN FIRE DOORS AND THE LIKE

This is a division of application Ser. No. 448,621, filed Dec. 10, 1982, now abandoned.

BACKGROUND OF THE INVENTION

I. Field of the Invention

This invention relates to the securement of glass in fire doors and the like. More particularly, the invention relates to such securement avoiding the use of visible metal parts.

II. Description of the Prior Art

The use of windows or lights in fire doors is advantageous because a person escaping from a fire can immediately see whether it is safe to open the door or whether the fire is worse on the other side. Furthermore, as fire doors usually have to be kept closed at all times, the presence of windows or lights provides a building with a less claustrophobic appearance.

The disadvantage of the use of windows or lights in fire doors is that they can reduce the ability of the door to prevent the spread of fire. Heat-resistant glass can be employed, but the frame around the glass is susceptible to burning. To overcome this, metal frames are often provided around the windows or lights, but when the fire door itself is made of wood, this significantly reduces the attractiveness of the door. The use of metal frames can also be expensive.

It is therefore an object of the present invention to provide an alternative to the use of metal frames without reducing the fire retardancy of the door below specified levels.

SUMMARY OF THE INVENTION

According to one aspect of the invention there is provided a glazing strip for fire barriers comprising an elongated strip made of a wood-like material formed from a slurry mixture of wood fibers and a fire retardant chemical through the use of heat and pressure.

The elongated strip is preferably made of a plurality of layers of the wood-like material of uniform thickness that are adhered to one another.

According to another aspect of the invention there is provided a clip for mounting heat-resistant glass in an opening in a fire barrier, comprising a thin, flat base of rigid heat-resistant material and a pair of projections upstanding from said base arranged parallel to each other and separated by a distance corresponding to the width of glass to be mounted.

According to yet another aspect of the invention there is provided a fire barrier having a glass panel therein, said glass panel being secured in said barrier by means of at least one clip comprising a thin flat base of heat-resistant material and a pair of projections upstanding from said base arranged parallel to one another and separated by a distance corresponding to the width of the glass panel, and elongated glazing strips on opposite sides of said panel at the edges thereof, said strips being made of a wood-like material formed from a slurry mixture of wood fibers and a fire retardant chemical through the use of heat and pressure.

The novel clips may be used in combination with the novel glazing strips at any time, but are preferably required when the glazing strips are thinner than $\frac{3}{4}$ inch in front of the glass. The clips can, of course, be used with other types of glazing strips.

DETAILED DESCRIPTION OF THE PREFERRED EMBODIMENTS

Figure 1:
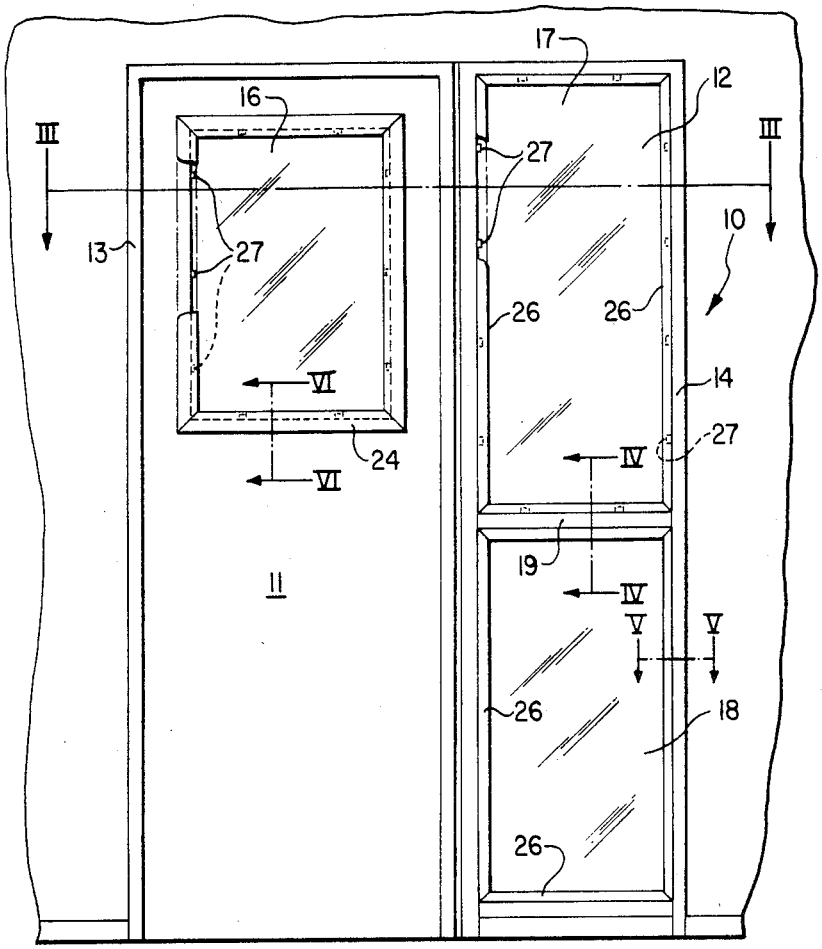
FIG. 1 is a front elevation of a fire barrier to which a preferred form of the present invention has been applied.

A typical application for the present invention is the fire barrier shown generally at 10 in FIG. 1. This barrier consists of a fire door 11 and a floor to ceiling, immovable side light 12.

The door 11 is mounted within a suitable fire-resistant frame 13, which may be a conventional fire-resistant door frame.

The side light 12 is also formed by a suitable fire-resistant frame 14, preferably of the same material as the door frame 13.

The door 11 may have any conventional fire-retardant structure and has a glass panel 16 made of a heat-resistant glass, e.g. one quarter inch thick wired glass. The side light 12 has two glass panels 17, 18 made of the same or similar heat-resistant glass. The two panels are mounted one above the other as shown and are separated by a cross-member 19 of the frame.

The difficulty in the past has been to mount the various glass panels within the door or frame in such a manner that the desired fire retardancy of the barrier 10 is maintained. This has been achieved by the use of metal glazing bars or stops to shield the junction between the glass and frame material and to fix the glass firmly in place. The mounting of the glass panels can now be carried out without the use of visible metal parts.

This is achieved by making the glazing bars or stops of a particular fire retardant material resembling wood. This material is made of pressed wood fibers containing a fire retardant additive, and is preferably used in the form of a plurality of thin sheets of such material laminated together. The material is formed by subjecting wood chips to either pressurized steam or a chemical bath to break the wood down into its individual fibers in the form of a wet slurry. This wet slurry is then reformed by spreading it onto the open screened surface mat where it is subject to pressure and heat. A natural chemical component of wood then flows to hold the wood fibers together in their new form. A fire retardant material is conveniently added during the manufacturing process while the fibers are still in a wet slurry in such a manner that the material is dispersed throughout the resulting wood product substantially uniformly. The amount of the fire retardant chemical is preferably in excess of 30% by weight of the sheet material. The fire retardant material may alternatively be impregnated into the individual fibers themselves. An aluminum compound, for example alumina, aluminum hydroxide or aluminum silicate, is a suitable fire retardant. Boron compounds are also known fire retardants and can be utilized. Preferably, the fire retardant compound is other than a salt as salts may leach out, but salts can be employed if desired. The specific gravity of the resulting fibre board is preferably greater than 0.80.

The material is preferably produced as thin (eg. quarter inch thick) sheets which can then be laminated together to any desired total thickness. This is preferable to forming a sheet of the total desired thickness because thicker sheets may have reduced internal strength, i.e., the fibers may tend to pull apart. Further, the laminated structure may also provide greater rigidity and improved ability to hold screws, nails and other fasteners.

The sheets can be adhered together using any suitable glue, but a glue sold under the trade mark UF 109 by Borden Chemicals Ltd. has been found especially advantageous because of its resistance to heat. The adhering of the sheets may be achieved by applying a layer of wet glue to both faces of alternate layers of the material, leaving the intervening layers dry. The layers are then built up to the desired total thickness and the combination is subjected in a press to pressure until the glue is cured.

Figure 2:
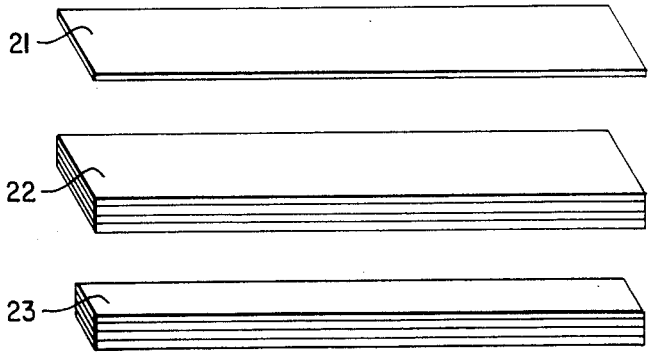
FIG. 2 shows the steps in preparing the material for the glazing strips used in one form of the invention.

The lamination technique is shown in FIG. 2, in which part (a) shows a single sheet of fiber board 21, part (b) shows four such boards laminated together to form a composite board 22, and part (c) shows a glazing bar or stop 23 made by cutting the composite sheet 22 to the required size. A veneer (if required) can be provided either on the composite sheet 22 or on the glazing bar or stop 23 after cutting.

A commercially available wood fiber board that is satisfactory for this application is one designated as X-90 ®-FT sold under a Flame Test ® panel brand by the Masonite Corporation. This material is obtained in wall panel sheets of typical thickness of 0.245 inch, with a specific gravity typically of 1.10, and includes an aluminum compound as a fire retardant in the proportion of approximately 35% of its weight. For use in the preferred forms of the present invention, such sheets are glued together to form a composite or laminated structure. Any number of sheets may be laminated in this way, but four such laminations usually provide the desired thickness.

This material was developed to prevent flame spread along the surface of the material when installed as wall paneling in buildings and mobile homes. However, it has been found that such material has improved fire penetration characteristics.

The composite material is highly resistant to burning and has a texture and appearance similar to wood. Further, the material retains nails, screws and other fasteners in much the same way as wood. As mentioned above, in order to improve the appearance of the product further, it may be provided with a wood veneer on the visible surfaces, which makes it virtually indistinguishable from wood.

The laminated wood fiber board is used to hold the glass panels in place and to shield the glass/frame junctions from heat and flame. FIGS. 3 to 6 show how the composite, fire-retardant material can be used in the fire barrier 10 shown in FIG. 1.

Figure 3:
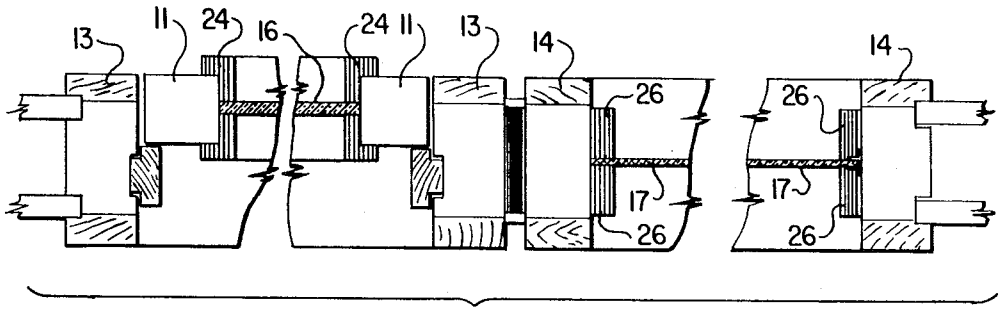

FIG. 3 is a cross-section of the barrier 10 taken on the line III—III in FIG. 1. The composite, fire-retardant material is used for the glazing strips, i.e., for the glazing bars 24 for the glass panel 16 in door 11, and in glazing stops 26 for the glass panel 17 (and similarly for panel 18) in the side light 12.

Figure 4:
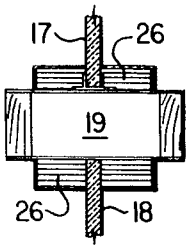
FIGS. 3 to 6 are cross-sections of various parts of the fire barrier of FIG. 1.
Figure 6:
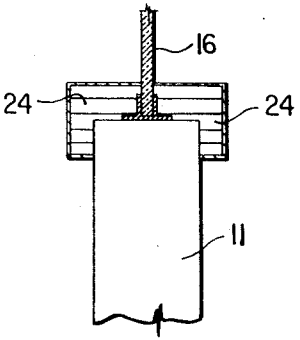
Figure 5:
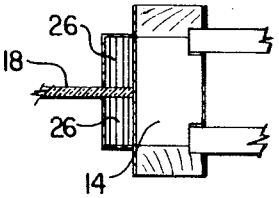

FIGS. 4 to 6 are, respectively, cross-sections taken along the lines IV—IV, V—V and VI—VI of FIG. 1 to show the glazing strips in greater detail.

The glazing strips can be fixed in position by any suitable conventional means, e.g. by nails, screws, glue, etc. By themselves these strips are suitable for holding the glass panels in position when their thickness in front of the glass surface is at least $\frac{3}{4}$ inch and their fire retardancy then prevents penetration by flame around the edges of the glass panels. The dimensions of the strips can be chosen according to the design of the fire barrier and according to the degree of fire retardancy required. Naturally, the strips should be present all around the glass panels on both sides to form an effective fire seal.

When the thickness of the strip in front of the glass is less than $\frac{3}{4}$ inch it is desirable, in order to maintain adequate fire retardancy, to use novel clips to fix the glass panels in position in addition to the fire retardant glazing strips themselves. When this is done, the glass panels remain in place even when the strips are burnt away, so that the panels can still resist pressure differences on opposite sides of the barrier and even the force of fire hoses directed against the barrier.

Figure 7:
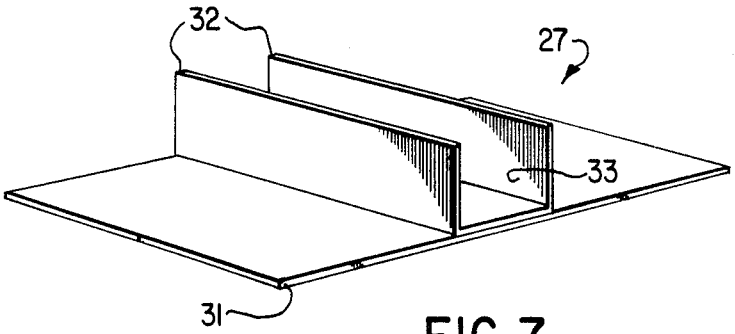
FIGS. 7 to 9 are perspective views of various clips used in the invention.
Figure 8:
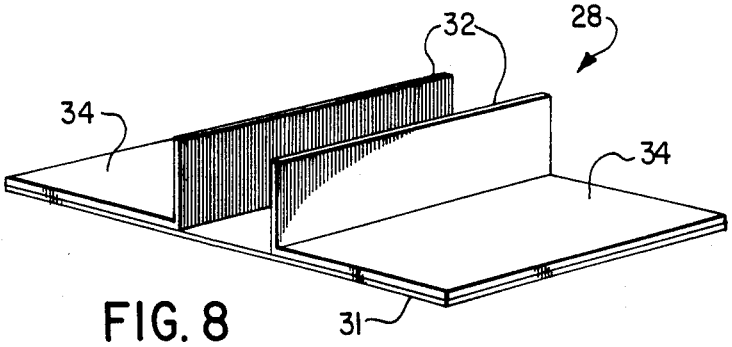
Figure 9:
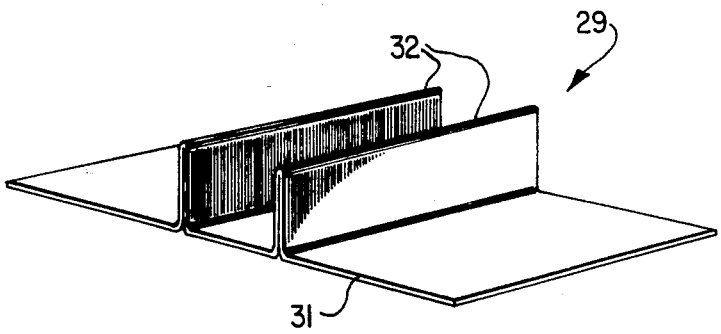

Examples of the novel clips are shown in FIGS. 7 to 9, the clips being indicated by the reference numerals 27, 28 and 29 respectively. Basically, each clip comprises a flat base plate 31 and a pair of uprights 32. The uprights 32 are separated by a distance corresponding to the width of the glass panel with which they are to be used. The uprights engage each side of the glass panel adjacent an edge and the flat base 31 is nailed, screwed, glued or otherwise attached to the opening for the glass in the door or frame. A number of such clips are used for each glass panel, and preferably they are spaced about twelve inches apart (and about 6 inches from each corner) to provide adequate support for the panel. Glazing bars or stops of the type described above are then secured against the panel edges to hide the clips and provide the desired fire retardancy. In this way, no metal parts are visible in the finished barrier which appears to be constructed entirely of wood.

Clip 27 consists of a channel member 33 soldered, welded or otherwise attached to the mid-line of the flat base 31. The sides of the channel member form the uprights 32.

Clip 28 has a pair of L-shaped members attached to the flat base 31, the angled parts forming the uprights 32.

Clip 29 is made from a single plate bent to form the flat base 31 and uprights 32.

The clips can be made from any rigid, heat-resistant material, but metal is preferred and galvanized steel sheet is ideal. The clips may be made of any suitable size to suit any application. The most usual size for the flat base is $1 \times 1\frac{5}{8}$ inches, the uprights usually extend $\frac{1}{4}$ inch from the base and are usually separated by a distance of $\frac{1}{4}$ inch, although this depends entirely on the thickness of glass to be employed.

The clips 27 may be positioned as shown in FIG. 1. In this case, no clips are provided on the lower panel 18 of the side light 12. This is because the lower panel would be subjected to less heat and flame during a normal fire, as heat rises, and therefore does not need the additional support. The clips may however be provided if desired.

Figure 10:
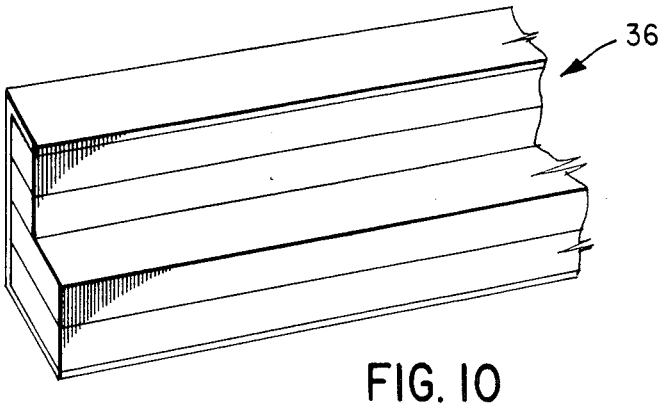
FIGS. 10 and 11 show a glazing bar in greater detail.
Figure 11:
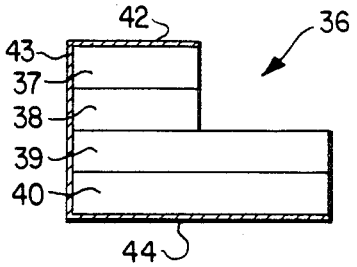

FIGS. 10 and 11 show an example of a glazing bar 36 according to one form of the invention. This is L-shaped in cross-section so that it can be used in the manner shown in FIG. 6 for similar bars 24. The four layers 37, 38, 39, 40 are shown in FIG. 11 together with wood veneer layers 42, 43, 44. If just a paint grade product is required, the layers of veneer can be omitted. The bar 36 differs in shape from the glazing stops, e.g. as shown at 26 in FIG. 3, which are rectangular in cross section, but they are otherwise the same. The bars and stops can be made in any desired cross-sectional shape and length. Standard lengths can be produced and cut to size on site, or lengths designed to fit particular standard doors can be made.

Figure 12:
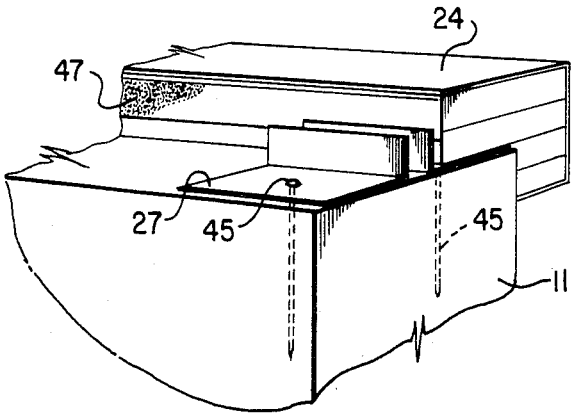
FIG. 12 shows the manner in which a clip and glazing bar can be attached to the fire barrier.

FIG. 12 shows more clearly the way in which the clips and glazing strips may be secured to a door or door frame. The clip 27 is first secured to door 11 by means of nails 45 (the glass panel—not shown—may be manoeuvered into position with the clips attached to it and then the clips may be nailed in place). A layer of double-sided adhesive tape 47 is then attached to the glazing bar 24, which is then located in the position shown by an adhesive or by nailing or the like. A similar glazing bar with double-sided adhesive tape is attached on the other side of the glass panel. The adhesive tape acts as a seal between the glazing bars and the glass and temporarily secures the glazing bars in place while they are being permanently attached.

When the glazing strip is to be attached by nails or screws, it is preferable to ensure that they pass through the laminate material at right angles to the laminations. For example, the nails or screws would be introduced into the upper surface of the bar 24 shown in FIG. 12. The laminate material has an improved ability to retain nails and screws when they traverse the laminations rather than extend parallel to them.

The following Example illustrates one preferred form of the present invention.

EXAMPLE

A fire barrier of the design shown in FIG. 1 (45 inches high by 52 inches wide) was manufactured using glazing strips comprising four laminations of X-90 ®FT wood fiber material. These strips were of the shape shown in FIG. 12, the outer dimension being 1 inch by $1\frac{1}{4}$ inches and the cut-out portion being $\frac{1}{2}$ by $\frac{3}{4}$ inch. The visible faces were veneered. Metal clips were used where shown in FIG. 1.

The barrier was subjected to a fire test by an independent laboratory (Warnock Hersey Professional Services Ltd., Vancouver, Canada). Five burners were each placed six inches from the barrier and the average temperatures that the exposed face of the barrier was subjected to were as follows:

5 minutes: 1036° F.
10 minutes: 1301° F.
15 minutes: 1390° F.
20 minutes: 1474° F.

The barrier contained the fire for 20 minutes. The burners were then turned off and the barrier was subjected to a hose stream against the exposed (burnt) face from a hose having a 28 mm discharge tip. The hose produced a pressure of 207 Kpa and the barrier was sprayed in a zig-zag pattern for an average of 6.7 seconds per square meter (32 seconds in total).

The barrier stood up to the fire test and the hose stream test adequately, i.e., there were no visible openings through the barrier.

The invention is not limited to the details of the preferred embodiment referred to above and includes modifications that would be apparent to a person skilled in this art and that fall within the scope of the following claims.

I claim:

1. In a fire barrier for a building wherein said barrier comprises at least one panel of heat resistant glass having non-metallic glazing bars at its periphery, the improvement comprising a plurality of heat-resistant rigid metal clips each comprising a thin flat base and a pair of flat projections upstanding from said base arranged parallel to each other and separated by a distance corresponding to the width of said glass panel, said clips securing the glass panel in the fire barrier beneath said glazing bars with their bases securely attached to the barrier and the glass panel held between said flat projections.

2. A fire barrier according to claim 1 wherein said clips comprise a channel member having upright sides forming said projections and an interconnecting web extending between said sides at their lower ends, said web being attached to the thin flat base along a mid line thereof.

3. A fire barrier according to claim 1 wherein said clips comprise a pair of L-shaped members attached to said thin flat base, one part of each L-shaped member forming one of said projections and the other part being attached to the base.

4. A fire barrier according to claim 1 wherein said clips comprise a single plate of thin metal bent in such a manner that each of said projections is formed by a double thickness of said plate and said base is formed by a single thickness of said plate.

5. A fire barrier according to claim 1, wherein said clips are made of galvanized steel.

6. A fire barrier according to claim 2 wherein said clips are made of galvanized steel.

7. A fire barrier according to claim 1, wherein the clips are spaced about twelve inches apart around the periphery of the glass panel and, when said glass panel has corners, about six inches from each corner.

8. A fire barrier according to claim 1, wherein said non-metallic glazing bars are impregnated with a fire retardant additive.

9. A fire barrier according to claim 1 wherein said non-metallic glazing bars are made of a material resembling wood comprising pressed wood fibers and a fire retardant additive.

10. A fire barrier according to claim 9 wherein said bars comprise a plurality of layers of said material resembling wood laminated together.

11. A fire barrier according to claim 8, wherein the thickness of the glazing bars in front of the glass panel is less than $\frac{3}{4}$ inch.

12. A fire barrier according to claim 1, wherein a layer of double sided adhesive tape is located between the glass panel and adjacent surfaces of said glazing bars to form a seal.

13. In a fire barrier for a building wherein said barrier comprises at least one panel of heat resistant glass having non-metallic glazing bars at its periphery, the improvement comprising a plurality of heat-resistant clip elements comprising base members and flat projections upstanding from the base members, the flat projections being arranged in parallel planes separated by a distance corresponding to the width of said glass panel, said clip elements securing the glass panel in the fire barrier beneath said glazing bars with the base members securely attached to the barrier and the glass panel held between said flat projections.

* * * * *